US007034774B2

(12) United States Patent
Kuo et al.

(10) Patent No.: US 7,034,774 B2
(45) Date of Patent: Apr. 25, 2006

(54) FEED STRUCTURE AND ANTENNA STRUCTURES INCORPORATING SUCH FEED STRUCTURES

(75) Inventors: Steven Szu-Cherng Kuo, Torrance, CA (US); Andrew Lee Roberts, Newhall, CA (US); James David Ingram, Seal Beach, CA (US); Imants Eglitis, Torrance, CA (US); Henry Chang, Palos Verdes, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 18 days.

(21) Appl. No.: 10/883,876

(22) Filed: Jul. 2, 2004

(65) Prior Publication Data

US 2005/0237253 A1 Oct. 27, 2005

Related U.S. Application Data

(60) Provisional application No. 60/564,323, filed on Apr. 22, 2004.

(51) Int. Cl.
*H01Q 15/02* (2006.01)

(52) U.S. Cl. ..... 343/909; 343/786; 343/756

(58) Field of Classification Search ..... 343/786, 343/756, 789, 898, 909, 906
See application file for complete search history.

(56) References Cited

U.S. PATENT DOCUMENTS 3,906,508 A * 9/1975 Foldes ..... 343/786
4,122,406 A * 10/1978 Salzberg ..... 333/113
4,195,270 A * 3/1980 Rainwater ..... 333/21 A
4,658,258 A * 4/1987 Wilson ..... 343/786
4,672,334 A * 6/1987 Saad ..... 333/21 A
4,797,681 A * 1/1989 Kaplan et al. ..... 343/786
5,117,240 A * 5/1992 Anderson et al. ..... 343/786
5,305,001 A * 4/1994 Wong et al. ..... 343/786
5,486,839 A * 1/1996 Rodeffer et al. ..... 343/786
5,552,797 A * 9/1996 Cook ..... 343/786
6,118,412 A * 9/2000 Chen ..... 343/756
6,137,450 A * 10/2000 Bhattacharyya et al. .... 343/786

OTHER PUBLICATIONS

S.J. Orfanidis "*Aperture Antennas*"; Electromagnetic Waves & Antennas; Feb. 28, 2004; pp 575-619.

* cited by examiner

*Primary Examiner*—Trin Vo Dinh
*Assistant Examiner*—Marie Antoientt Cabucos
(74) *Attorney, Agent, or Firm*—Tarolli, Sundheim, Covell & Tummino L.L.P.

(57) ABSTRACT

A polarizer for an antenna and antenna structures are disclosed. According to one aspect a polarizer includes a generally cylindrical sidewall portion extending between spaced apart end portions. At least one polarizing structure extends substantially continuously along an interior of the sidewall portion and extends radially inwardly relative to the sidewall portion according to a first radius in a longitudinal direction and a second radius in a transverse direction. The polarizer can be implemented as part of an antenna structure, which further can be integrated with a transition stage and/or a horn.

31 Claims, 6 Drawing Sheets

FEED STRUCTURE AND ANTENNA STRUCTURES INCORPORATING SUCH FEED STRUCTURES

CROSS REFERENCE TO RELATED APPLICATIONS

This application claims the benefit of provisional patent application No. 60/564,323, which was filed on Apr. 22, 2004, and entitled ANTENNA STRUCTURE AND METHOD OF MAKING ANTENNA STRUCTURE, and this application is related to U.S. patent application Ser. No. 10/844,107, which was filed on the same date as this application and entitled METHOD AND SYSTEM FOR MAKING AN ANTENNA STRUCTURE, both of which applications are incorporated herein by reference.

TECHNICAL FIELD

The present invention relates generally to antennas and, more particularly, to a feed structure and to related antenna structures.

BACKGROUND

A modern phased array (PA) antenna system typically requires hundreds, or thousands of radiating elements to form the antenna aperture. Thus, for a cost-effective PA system, a simple radiating element design is essential.

For the example of a geo-synchronous (GEO) satellite communication system operating at microwave frequencies, the intuitive choice of a radiating element is a horn antenna. This is because a horn antenna generally offers high aperture efficiency and high directive gain inside the relatively small coverage angle, such as within about ±9°. A circularly polarized electromagnetic radiation is also highly desirable, as it tends to eliminate the polarization alignment requirement between satellite and ground terminal antennas.

SUMMARY

The present invention relates to antenna components and to antenna structures.

One aspect of the present invention provides a polarizer for an antenna. The polarizer includes a generally cylindrical sidewall portion extending between spaced apart end portions. At least one polarizing structure extends substantially continuously along an interior of the sidewall portion and extends radially inwardly relative to the sidewall portion according to a first radius in a longitudinal direction and a second radius in a transverse direction. The polarizer can be implemented as part of an antenna structure, which further can be integrated with a transition stage and/or a horn.

Another aspect of the present invention relates to a feed structure for an antenna. The feed structure may comprise a polarizer that includes a sidewall portion having spaced apart ends, at least one polarizing structure extending from an interior of the sidewall portion of the polarizer. A transition stage is located at a proximal one of the ends of the sidewall portion of the polarizer, the transition stage comprising a step transition integrally formed with the polarizer.

Yet another aspect of the present invention relates to an antenna that may comprise a horn having a sidewall portion that includes a plurality of flare sections, at least some of the flare sections have different flare angles relative to a longitudinal axis thereof. A polarizer extends from a proximal end of the horn portion and terminates in a proximal end of the polarizer. The polarizer includes a sidewall extending longitudinally between spaced apart ends, at least one polarizing structure extending radially inwardly from the sidewall of the polarizer to provide a substantially continuous inward extension within the polarizer.

The foregoing examples can be employed, individually or in combination, to provide a compact horn antenna design capable of radiating a circularly polarized electromagnetic field. Additionally or alternatively, the structures can be employed in phased array antenna.

DETAILED DESCRIPTION

Figure 1:
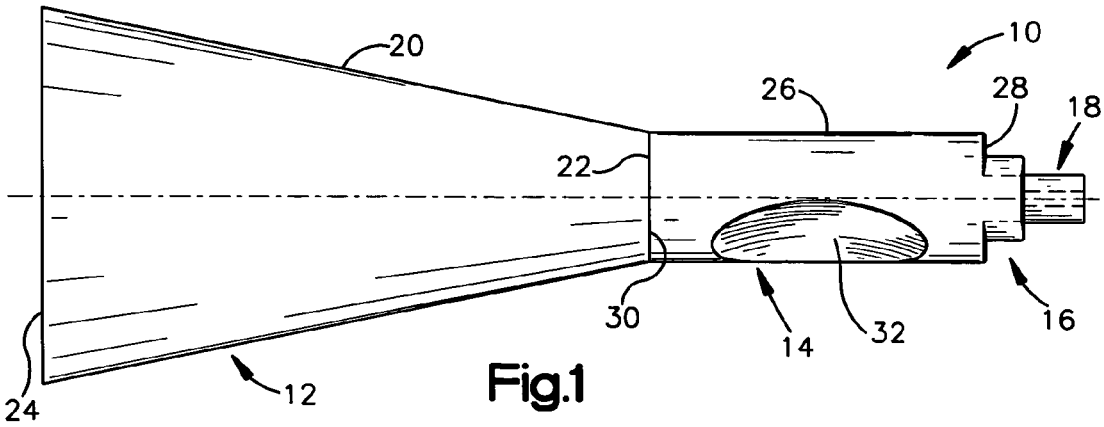
FIG. 1 depicts an example of a horn antenna apparatus according to an aspect of the present invention.

FIG. 1 depicts an example of a horn antenna 10 according to an aspect of the present invention. The horn antenna 10 includes a horn 12, a polarizer 14, a transition 16 and a wave guide port 18. In one embodiment, the horn antenna 10 can be manufactured as an integral structure (e.g., as a single piece) of a desired material. For instance, the antenna structure 10 can be machined from aluminum or an alloy thereof at a generally ambient temperature. Alternatively, the antenna structure can be injection molded or fabricated using other manufacturing methods (e.g., an electroforming process, a hipping process) and/or other materials (e.g., plastic, copper), with the materials being selected according to the method of manufacture and design specification of the antenna 10.

By way of example, the horn antenna 10 can be implemented as a compact horn antenna structure configured for radiating a circularly polarized electromagnetic field (e.g., right hand circular polarization (RHCP) or left handed circular polarization (LHCP)). A figure of merit for the antenna polarization is known as the axial ratio (AR) of the antenna, which is a ratio of RHCP and LHCP. For instance, the AR can be tuned to provide the desired type of polarization by configuring the polarizer 14 accordingly. A generally circular conical horn 12 configuration also facilitates providing circular polarization, which is desirable for many antenna applications. The horn 12 can also have other cross-sectional shapes, including, for example, hexagonal, octagonal, elliptical and rectangular to name a few. Those skilled in the art will appreciate that other horn shapes could also be utilized.

A typical multi-mode horn (e.g., Potter horn) can provide symmetric radiation patterns, but generally at the expense of lower aperture efficiency. For applications in which the antenna is employed in a phased array antenna application, such as for the GEO satellites, a relatively small scan angle (e.g., approximately ±9°) makes aperture efficiency more important than pattern symmetry. Consequently, a simple conical horn 12 or multi-flare horn (See, e.g., FIG. 5) may have increased utility in such applications.

By way of further example, for a simple conical horn 12 with one flare angle, the typical horn length may be about 66% longer than a multi-flare horn operating in the same modes. However, an increase in flare angle associated with the simple conical horn typically results in a corresponding decrease in the horn aperture efficiency, such that the antenna performance degrades. Since flare-angle changes in a horn can provide a means of pattern control and aperture efficiency, as described herein, the horn can be implemented as having a plurality of flare sections, as described herein (see, e.g., FIG. 5).

The horn 12 can include a generally smooth interior sidewall portion 20 (e.g., non-corrugated) extending between spaced apart ends 22 and 24 thereof. Alternatively, the horn 12 can be choked or corrugated, such as depicted in the alternative examples shown in FIGS. 6 and 7, respectively. The distal end 24 of the horn 12 provides an exit aperture for the antenna 10, which has a diameter according to antenna frequency requirements. The proximal end 22 is attached to or integral with the polarizer 14.

The polarizer 14 includes a generally cylindrical sidewall portion 26 extending between respective ends 28 and 30 thereof. The polarizer 14 includes one or more polarizing structures 32 located therein. Various types of polarizing structures can be utilized to polarize the electromagnetic field propagating through the polarizer 14. To provide desired polarization, typically a pair of diametrically opposed polarizing structures can be arranged along the interior of the polarizer sidewall 26. The angular position of the pair of polarizing structures 32 along the sidewall 26 generally determines the type and percentages of polarization (e.g., a percentage of RHCP relative to LHCP).

According to an aspect of the present invention, as depicted in the example of FIG. 1, the polarizing structure 32 can be implemented as a substantially continuous and smooth structure that extends radially inwardly relative to the polarizer sidewall 26 along part of interior of the sidewall portion. The radially inward extension of the polarizing structure 32 can itself be formed as an integral part of the polarizer sidewall, such as by deforming the sidewall radially inward in a predetermined, desired shape. Alternatively, another structure affixed to and extending from the interior of the sidewall 26 can be employed to provide the polarizing structure 32.

As another example, the polarizing structure 32 can be implemented as a vane type polarizer having a plurality of spaced apart protrusions extending radially from the interior of the polarizer sidewall. Alternatively, the polarizing structure 32 can be implemented as a continuous step structure (see, e.g., FIG. 3).

The transition stage 16 is located at the proximal end 28 of the polarizer 14. The transition stage 16 provides an interface between the waveguide 18 and the polarizer 14. As an example, the transition stage 16 can be implemented as a single, quarter-wavelength step transition between the waveguide and the polarizer 14. According to one aspect of the present invention, the transition stage 16 can be formed with the polarizer 14 as an integrated structure. For instance, the polarizer 14 and the transition stage 16 can be fabricated as an integrated feeder unit from the same material, such as machined from a single piece aluminum or an alloy thereof. Other manufacturing processes (e.g., hipping, electroforming, injection molding, electroplating, and the like) can also be employed to form the polarizer 14 and transition as an integrated structure.

According to a further aspect of the present invention, the horn 12 and the feeder unit, which includes the polarizer 14 and the transition stage 16, can be fabricated as an integrated antenna 10. The single piece construction can be facilitated by providing the horn 12 and the polarizer 14 with substantially smooth and continuous interior sidewall structures. Since the antenna 10 can be formed as an integral structure, assembly parts and joints can be eliminated. In addition to reducing the weight of the antenna 10, the single piece construction also facilitates the production process. Thus, by forming the antenna 10 with a substantially smooth, continuous internal structure, the antenna can be produced more efficiently and in a more cost effective manufacturing process relative to many other approaches. As an example, a per antenna cost savings for each antenna 10 is expected to exceed an order of magnitude.

By way of further example, the horn antenna 10 can be utilized in a SHF (super high frequency) band (e.g., from about 3 GHz to about 30 GHz) downlink phased array antenna for a geo-synchronous satellite communication application. For such an application, the aperture diameter of the horn antenna can be about 1.6 inch, and provide right-hand circular polarization (RHCP). Those skilled in the art will understand and appreciate that antennas having other aperture diameters and other types of polarization can also be provided according to an aspect of the present invention.

Figure 2:
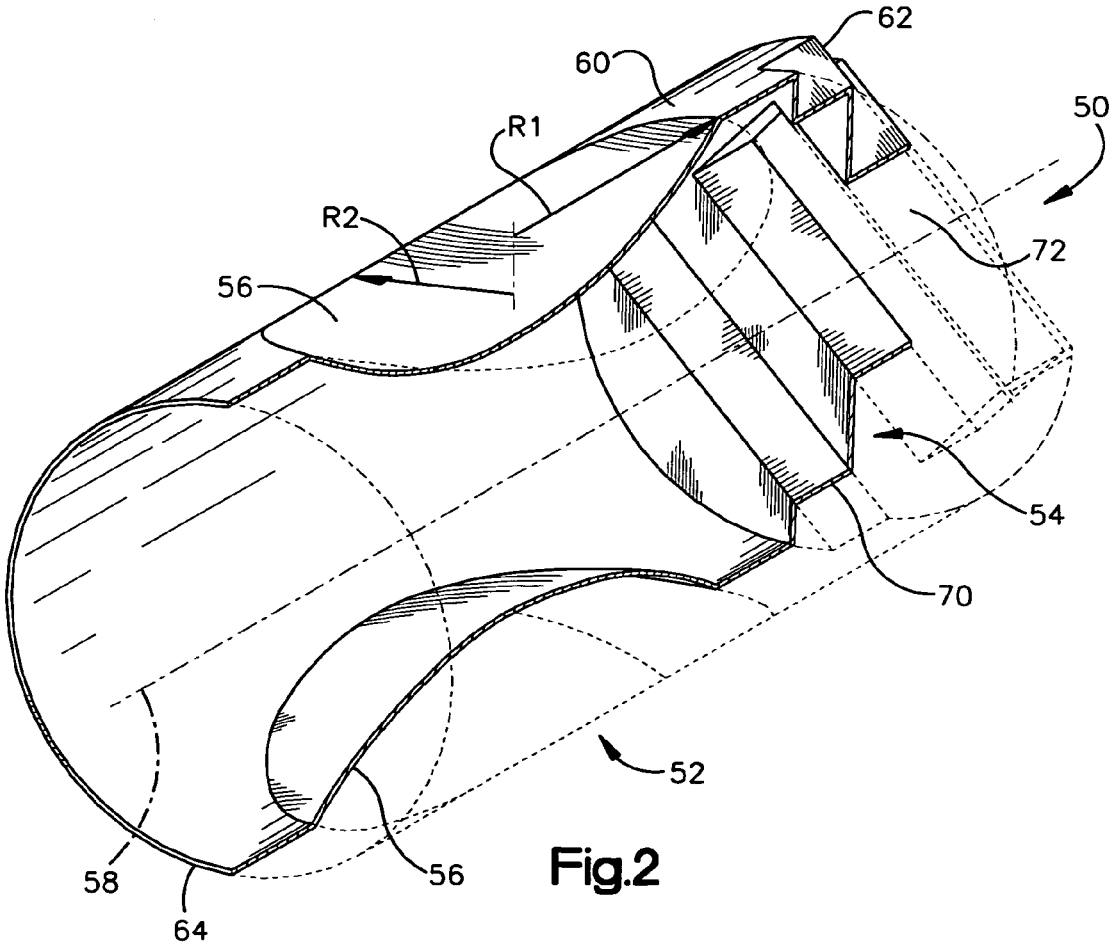
FIG. 2 depicts an example of a feed structure according to an aspect of the present invention.

FIG. 2 is a partial cross-sectional view depicting an example of a feeder assembly 50 according to an aspect of the present invention. The feeder assembly 50 includes a polarizer 52 and a transition stage 54. The polarizer 52 and transition stage 54 can be integrally formed as a single piece to provide the feeder assembly 50. Alternatively, the feeder assembly 50 can be part of an integrated antenna structure, such as described herein.

The polarizer 52 includes at least one polarizing structure 56. In the example of FIG. 2, the polarizer 52 includes a pair of substantially diametrically opposed polarizing structures 56. The polarizing structures 56 are oriented at an angular position relative to a longitudinal axis 58 to provide desired polarization. As mentioned above, the figure-of-merit of a polarizer is the axial ratio (AR), which is the measure of the capability to produce a circularly polarized electromagnetic field. AR can be expressed as a ratio of RHCP and LHCP. Thus, the angular orientation of the polarizing structures 56 can be selected to provide a desired AR for a given application.

The polarizer has a sidewall 60 that extends longitudinally between spaced apart ends 62 and 64. According to an aspect of the present invention, each of the polarizing structures 56 can be implemented as substantially smooth and continuous structures extending along an interior of the sidewall 60. For instance, the radially inward extensions can be formed as part of the sidewall 60, such as by deforming the sidewall 60 in a desired manner. In this approach, the interior of the sidewall 60 of the polarizer 52, including the radially inwardly extending polarizing structures, provides a substantially smooth and continuous surface.

The radially inwardly extending polarizing structures can be implemented in a variety of three-dimensional shapes in accordance with an aspect of the present invention. The particular shape of the radially inward extension can vary depending on system requirements and tuning that might be required to achieve desired performance. For example, the interior surface of the polarizing structures 56 can be completely smooth, it might contain some ripples or corrugations, or it could have apertures or other additional structures for implementing desired polarization, mode control and associated tuning. In the example of FIG. 2, the polarizing structures 56 extend radially inwardly relative to the sidewall 60 according to a first radius R1 in a longitudinal direction parallel to the axis 58 and a second radius R2 in a transverse direction. Thus, according to an aspect of the present invention, the dual radii shape can be characterized as any one of a generally semi-torus or semi-ellipsoidal shape, such as shown in FIG. 2. Alternatively, other three-dimensional curved contours (e.g., conical sections, semi-spheroidal and the like) can be employed to implement the polarizing structures 56.

A substantially smooth and continuous surface in the interior sidewall 60 of the polarizer 52 facilitates manufacture of the feeder assembly 50. The generally semi-torus shape of the polarizing structures 56 illustrated in FIG. 2, for example, not only provides continuous profile along the circular waveguide direction, but also adds profile control to the orthogonal direction. As a result, the polarizer 52 can be fabricated to provide a desired AR. Additionally, the polarizer 52 configuration can be significantly shorter than a typical vane polarizer (e.g., 1.5" versus 2.5" for a similar vane polarizer), which reduces the manufacturing complexity and weight considerably. Accordingly, the substantially smooth-wall polarizer 52, according to an aspect of the present invention, can be employed to replace discrete plate and other polarizing structures used in existing and proposed antenna designs.

The transition portion 54 of the feeder assembly 50 is depicted in FIG. 2 as including a single step transition 70. The single step transition can be implemented as a quarter-wavelength step transformer configured to match the impedances of two different interfaces, namely those of a waveguide input 72 (e.g., a rectangular input) and the polarizer 52 (e.g., a circular cross-sectional polarizer). A single step transition can further reduce the total length of feeder assembly and the resulting antenna, as well as facilitate single-piece fabrication.

Figure 3:
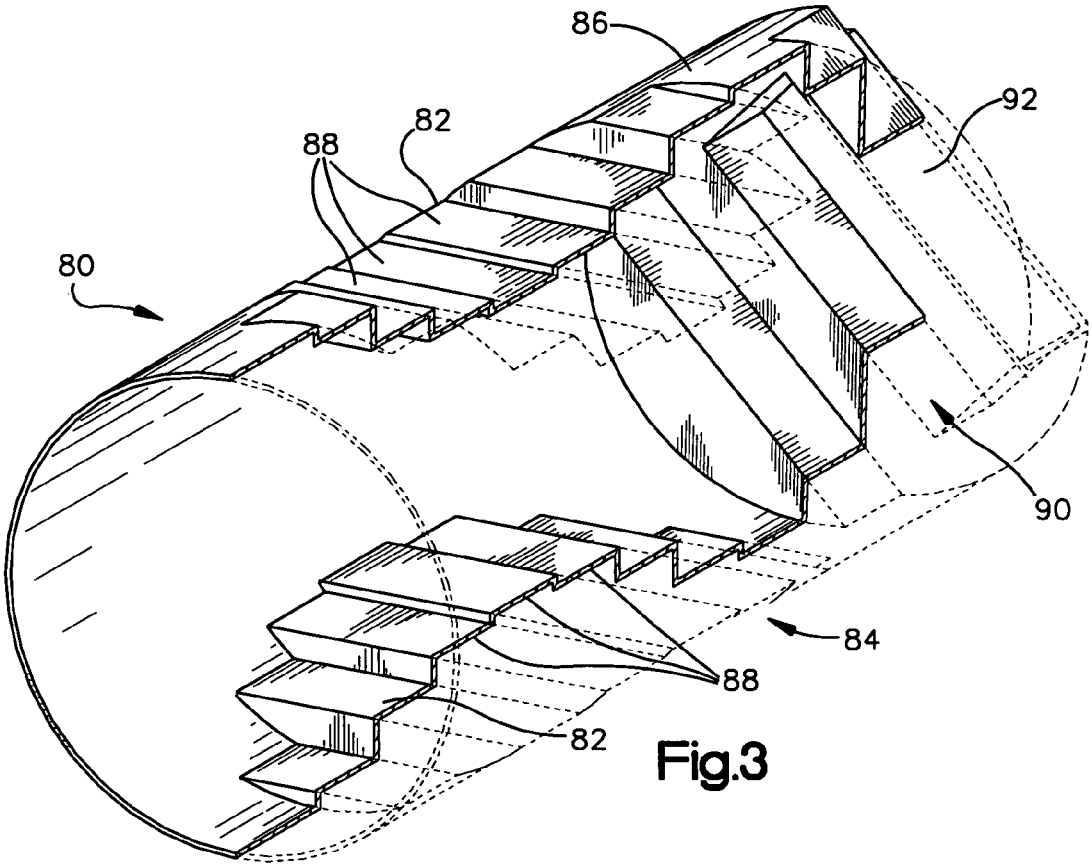
FIG. 3 depicts an example of a feed structure according to another aspect of the present invention.

FIG. 3 depicts an alternative feeder assembly 80 that can be utilized in an antenna according to an aspect of the present invention. The feeder 80 is similar to the feeder of FIG. 2, but includes a different configuration of polarizing structures 82 in the polarizer 84. Similar to FIG. 2, the polarizer 84 includes a pair of polarizing structures 82 that extend radially inwardly from a sidewall 86 of the polarizer. The pair of polarizing structures 82 are depicted as a pair of substantially diametrically opposed continuous structures. Each of the polarizing structures 82 includes a plurality of transversely extending steps 88 arranged longitudinally along the sidewall 86 of the polarizer 84. The continuous step structure provides good circular polarization, and simplifies manufacture process relative to many existing approaches, such as the discrete plate or vane polarizing structures mentioned above.

The feeder assembly 80 also includes a single step transformer 90 that forms a transition stage configured to provide a desired interface between a waveguide input 92 and the polarizer 84. The polarizer 84 and transition stage can be integrally formed as a single piece to provide the feeder assembly 80. The feeder assembly 80 can also be part of a single piece integrated antenna structure, such as described herein.

Figure 4:
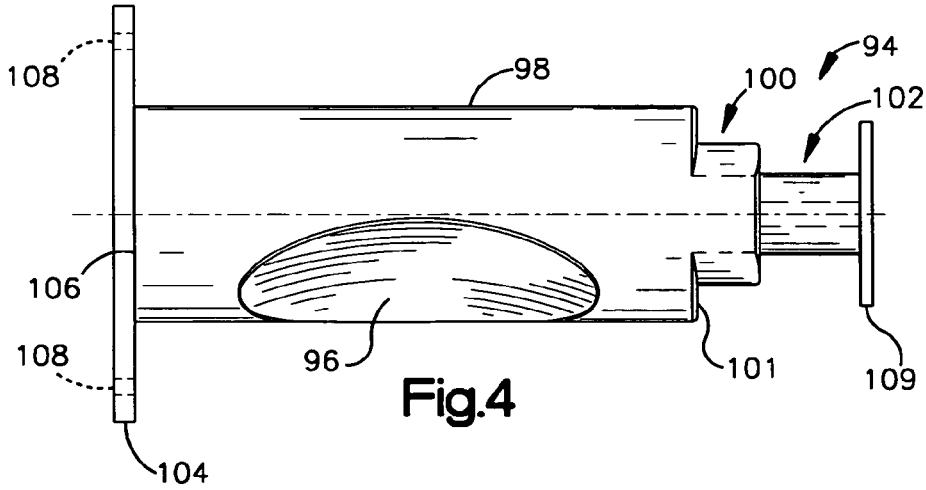
FIG. 4 depicts an example of an integrated feed structure having a polarizer and transition according to an aspect of the present invention.

FIG. 4 depicts an example of an integrated polarizer-transition structure 94. The polarizer-transition structure 94 can be fabricated from a single piece of material (e.g., aluminum 6061 or other electrically conductive materials and coatings) for use with a variety of horn configurations.

The polarizer-transition structure 94 includes a pair of substantially diametrically opposed polarizing structures 96, such as substantially smooth and continuous radially inward extensions along the sidewall 98 shown and described in FIG. 2. The polarizer-transition structure 94 includes a transition stage 100 at a proximal end 101 thereof, which can be coupled to or integrally formed with a wave guide input 102. The polarizer-transition structure 94 also includes a flange (or other means) 104 for attaching a distal end 106 of the polarizer sidewall 98 to a horn (not shown). The flange 104, for example, includes apertures 108 that can be employed with either bolts or rivets to fasten the polarizer-transition structure 94 to a corresponding flange (or other structure) of the horn. Another flange 109 is also provided at the waveguide port, which can be employed to couple the proximal end 101 to a waveguide or mounting plate by a suitable fastener (e.g., nuts and bolts or rivets).

Figure 5:
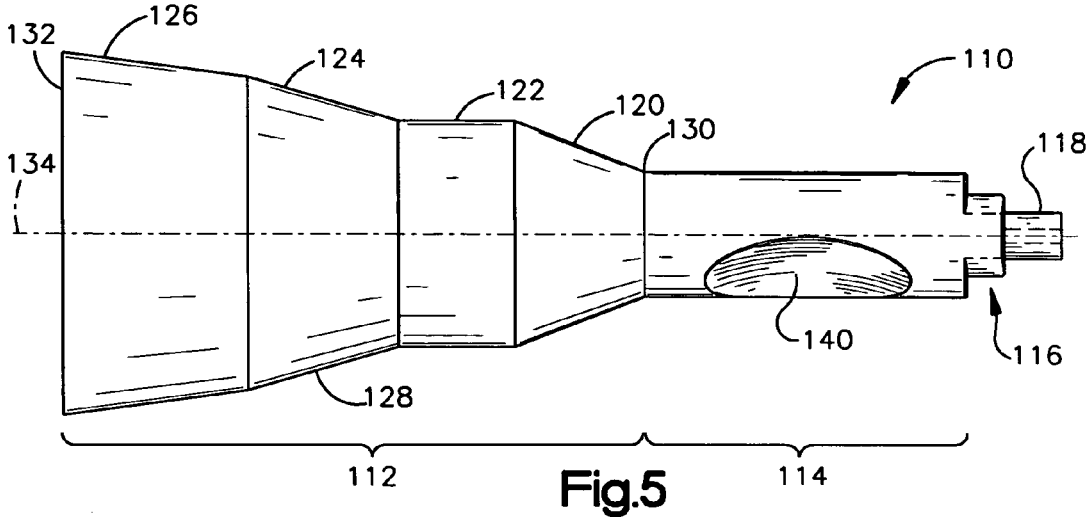
FIG. 5 depicts an example of a horn antenna apparatus according to an aspect of the present invention.

FIG. 5 depicts an example of a multi-flare horn antenna 110 that can be implemented in accordance with an aspect of the present invention. The antenna 110 includes a horn section 112, a polarizer 114, a transition 116 and a waveguide input 118.

In the example of FIG. 5, the horn 112 is a multi-flare horn that includes four flare sections 120, 122, 124 and 126. The flare sections 120, 122, 124 and 126 collectively define a sidewall 128 of the horn 112, which extends longitudinally between spaced apart ends 130 and 132. Each of the flare sections 120, 122, 124 and 126 can have different flare angles relative to a central axis 134 that extends longitudinally through the horn sidewall 128. An aperture of the horn 112 is provided at the distal end 132 of the horn associated with flare section 126. The proximal end 130 of the horn sidewall 128, corresponding to flare section 120, interfaces with the polarizer 114 to provide a transition region.

The flare angles of the flare sections 120, 122, 124 and 126 determine the operating modes and patterns of radiating waves for the antenna 110. The flare angles can be designed to configure percentages of desired radiation modes as well as control radiation patterns and/or frequency bands capable of being propagated by the antenna 110. The section 120 has a corresponding flare angle to provide a desired interface with the polarizer 114. The next section 122 is depicted as a substantially circular cylindrical member that operates to implement phase matching. The other sections 124 and 126 each have flare angles selected to control the modes of radiation and propagation velocities. The flare section 126 also has a diameter configured to provide the aperture at the end 132, which can vary depending on the application and system requirements of the antenna 110.

Those skilled in the art will understand and appreciate various types and configurations of polarizer 114 that can be utilized in conjunction with the multi-flare horn portion 112. For example, the polarizer 114 can include a pair of polarizing structures 140, such as the type shown and described in FIG. 2 (also shown in FIG. 5). Alternatively, other types of polarizing structures, such as the type shown in FIG. 3 or a vane polarizer, could also be utilized with the four flare horn 112 according to an aspect of the present invention. The transition stage 116 would be further be configured according to the type of waveguide input and the type of polarizer 114.

As described herein, the multi-flare design affords a reduced horn length while improving the horn aperture efficiency relative many existing horn designs. For example, the figure-of-merits of a horn are the aperture efficiency and radiation pattern symmetry. A horn with high aperture efficiency provides desired high antenna gain. A horn with symmetric radiation patterns is desired for circularly polarized electromagnetic field application, because the polarization efficiency is high. The antenna 110 can be implemented with the four-flare horn to have a relatively short length (e.g., about 2.4"), high aperture efficiency (e.g., >about 90%), and have good pattern symmetry. Additionally, the simple structure associated with having a substantially smooth interior sidewall 128 further helps reduce the antenna's weight and facilitates its fabrication.

For example, the horn 112 can be formed as an integrated unit with the polarizer 114, such as described herein. Alternatively, the horn 112 could be attached to the polarizer 114, such as by fasteners or clamping devices. Those skilled in the art will further understand and appreciate that the transverse cross-section of the horn 112 can also have a variety of shapes, which can vary depending on system requirements. For instance, the horn or flare sections thereof can have a circular cross-sectional shape, an elliptical cross-sectional shape, a rectangular cross-sectional shape, a pyramidal shape, a hexagonal cross-sectional shape, an octagonal cross-sectional shape, a continuous bell shape, etc.

Figure 6:
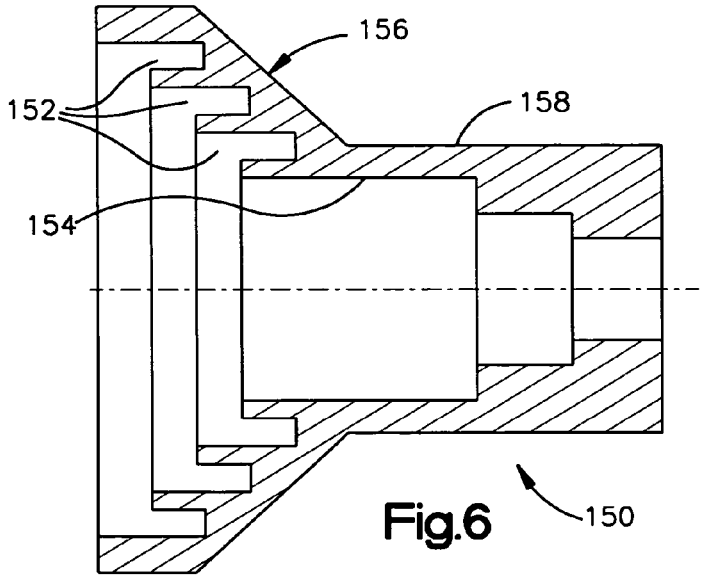
FIG. 6 is a cross-sectional view of a choke horn structure according to an aspect of the present invention.
Figure 7:
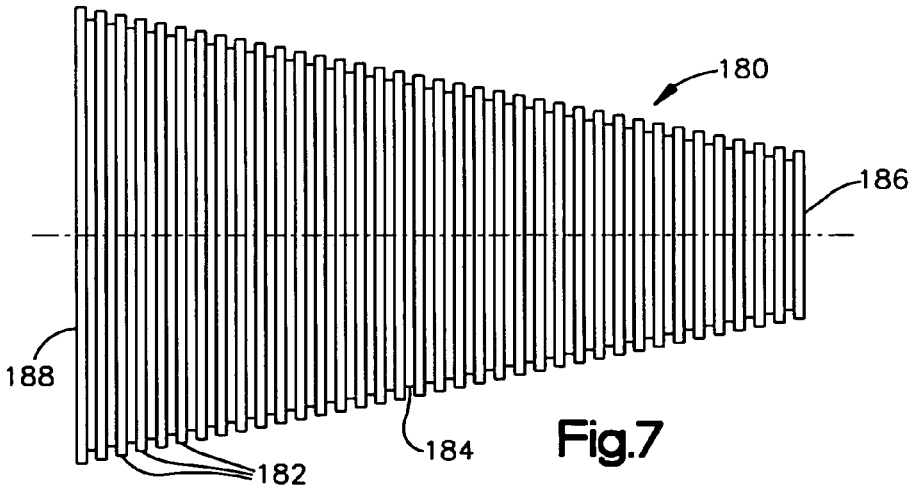
FIG. 7 is a cross-sectional view of a corrugated horn structure according to an aspect of the present invention.

While, according to one aspect of the present invention, a horn portion of antenna can be provided with a substantially smooth sidewall, the horn portion can also be implemented with a non-smooth interior sidewall portion. By way of example, FIGS. 6 and 7 depict the interior for two additional different types of horns that can be utilized in an antenna according to an aspect of the present invention. The various structures that can be employed along the interior of the horn operate to control the modes of electromagnetic waves that propagate through the horn as well as the radiation patterns of such waves.

FIG. 6 depicts an example of a generally choke horn antenna structure 150 that can be employed in an antenna. The horn antenna 150 includes a plurality of chokes 152 along an interior sidewall portion 154 of the horn 150. The chokes 152 provide effective control of the mode content in the horn aperture to generate radiation patterns, such as having predetermined (e.g., substantially equal) E-plane and H-plane beam widths, low cross-polarization, and suppressed side lobes. As depicted in FIG. 6, the chokes 152 are annular notches that have both radial and axial dimensions. In the illustrated example of FIG. 6, three chokes are provided at an internal transition location between a conical profile section 156 and a cylindrical aperture section 158 of the horn antenna 150.

The size and location of the chokes 152 can be optimized for desirable mode content at the frequency band of interest and to allow the propagation modes to be properly phased relative to each other so that the useful bandwidth of the signal propagates in a desired manner. Those skilled in the art will understand and appreciate various types and configurations of chokes that can be employed in a horn for use in an antenna according to an aspect of the present invention.

FIG. 7 depicts an example of a corrugated horn 180 that can be employed in an antenna. In the example of FIG. 7, the horn 180 includes a plurality of corrugations or channels 182 extending circumferentially along an interior sidewall 184 of the horn. The corrugations are arranged between spaced apart ends 186 and 188 of the horn. The corrugations 182 (e.g. depth and width of the corrugations) can be configured according to design requirements and to provide desired mode content at the frequency band or bands of interest. Various other types of corrugated horns could be employed in an antenna, including, for example, corrugated scalar feed horn antenna, corrugated conical horn with axial slots, and corrugated conical horn with ring loaded radial slots, to name a few.

The examples of FIGS. 6 and 7 depict but two examples of different types of features that can be provided in horn structures. Those skilled in the art may appreciate other features or types of structures and combinations of features that can be implemented in a horn for use in an antenna according to an aspect of the present invention. For example, spiral channels ridges or other forms of discontinuities can be provided along the interior sidewall.

Figure 8:
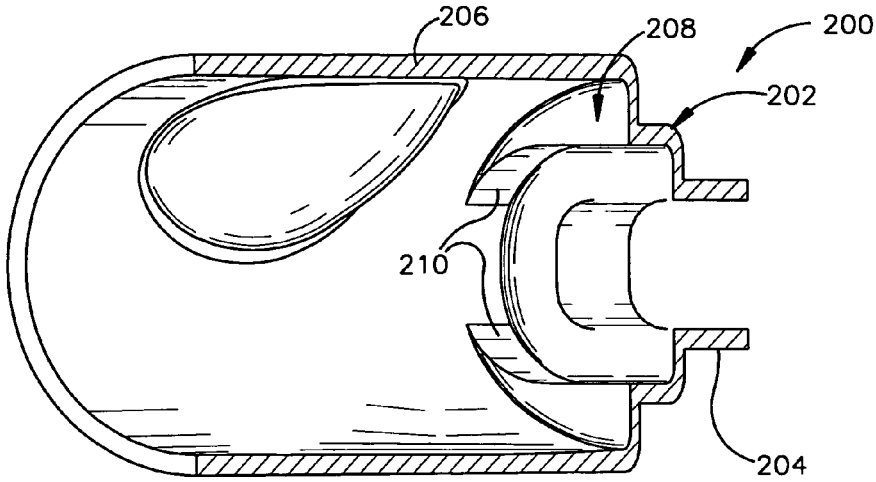
FIG. 8 depicts an example of a single-step transition stage according to an aspect of the present invention.

FIG. 8 depicts a cross-sectional view of part of a polarizer-transition assembly 200 to better illustrate an example of a transition stage 202 that can be implemented according to an aspect of the present invention. The transition stage 202 provides an interface between a waveguide 204 and a polarizer section 206 of the assembly 200. By way of further example, RF power output from a solid state amplifier (not shown) can be provided to the rectangular waveguide input 204, and the polarizer 206 can have a circular cross section. Accordingly, the assembly 200 includes the transition stage 202 to transport RF output power from the rectangular waveguide to the polarizer 206.

The figure-of-merit of the transition is the return loss, which corresponds to a measure of the amount of RF power that reflects back toward the source. A typical transition is a tapered such that its cross section changes gradually to mate the two interfaces (the polarizer 206 and waveguide 204). A tapered transition, however, usually requires a length of one wavelength or longer to achieve suitable performance.

In the example of FIG. 8, by contrast, the transition stage 202 is implemented as a quarter-wavelength single stage transformer 208. This single stage transformer 208 is configured as a single step to substantially match the impedances of the two different interfaces. The single stage transformer 208 has the advantages of short length and excellent return loss (e.g., less than −25 dB). The transformer 208 design can also tolerate rounded corners, indicated at 210, without causing a significant reduction in performance. Thus, standard cutting tools can be employed to mill out the step transition shape during single-piece fabrication. For example, when combined with a horn structure, such as shown and described herein, the step transformer can be machined from aperture side of horn. Such machining can be further facilitated, for instance, by implementing the horn as multi-flare horn having substantially smooth sidewalls and a corresponding polarizer (see, e.g., FIGS. 1 and 5).

Figure 9:
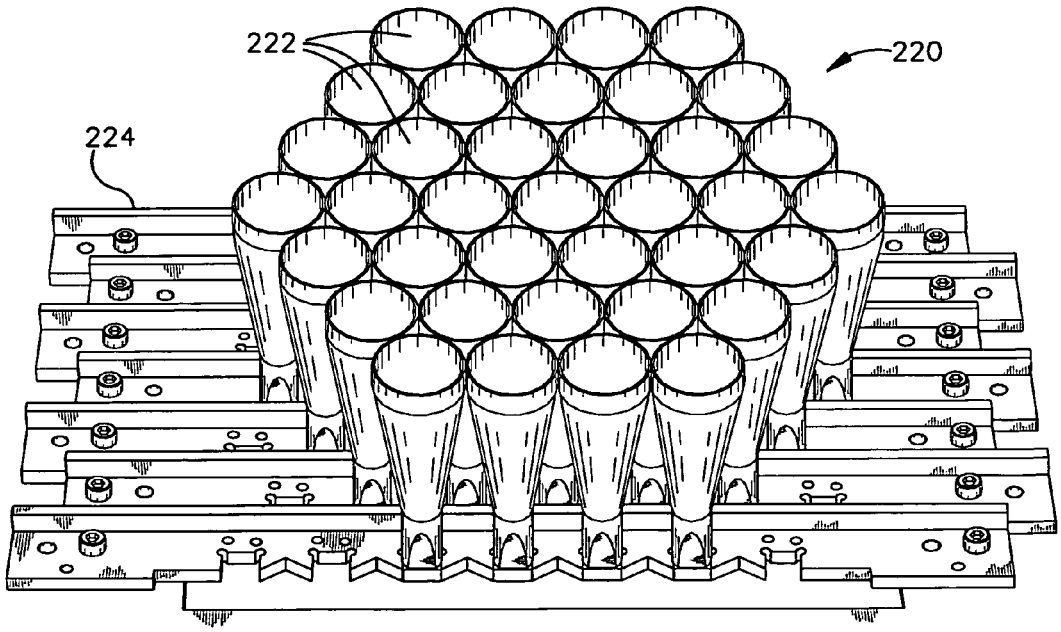
FIG. 9 depicts an example of a phased array antenna according to an aspect of the present invention.

FIG. 9 depicts an example of a phased array antenna 220 that can be constructed from a plurality of antennas 222 according to an aspect of the present invention. The antennas 222 are shown attached to a mounting plate 224. By fabricating the antennas 222 using single piece construction and with substantially smooth interior portions, as described herein, each antenna can have a decreased weight when compared to many existing antenna designs. As a result, the weight of the phased array antenna 220 can be further reduced by an amount proportional to the number of antennas 222 (e.g., often including hundreds or thousands of antennas).

When combining feed components into an integrated assembly, the usual approach is to fabricate separate pieces and fasten the sections together using either bolts or rivets. This typical approach introduces a pair of flanges and clamping hardware at each interface, resulting in added weight. Thus, it is undesirable in satellite antenna applications. In contrast, a single-piece antenna structure, according to an aspect of the present invention, is highly desirable, as it offers minimal weight, reduced assembly effort and low cost.

Figure 10:
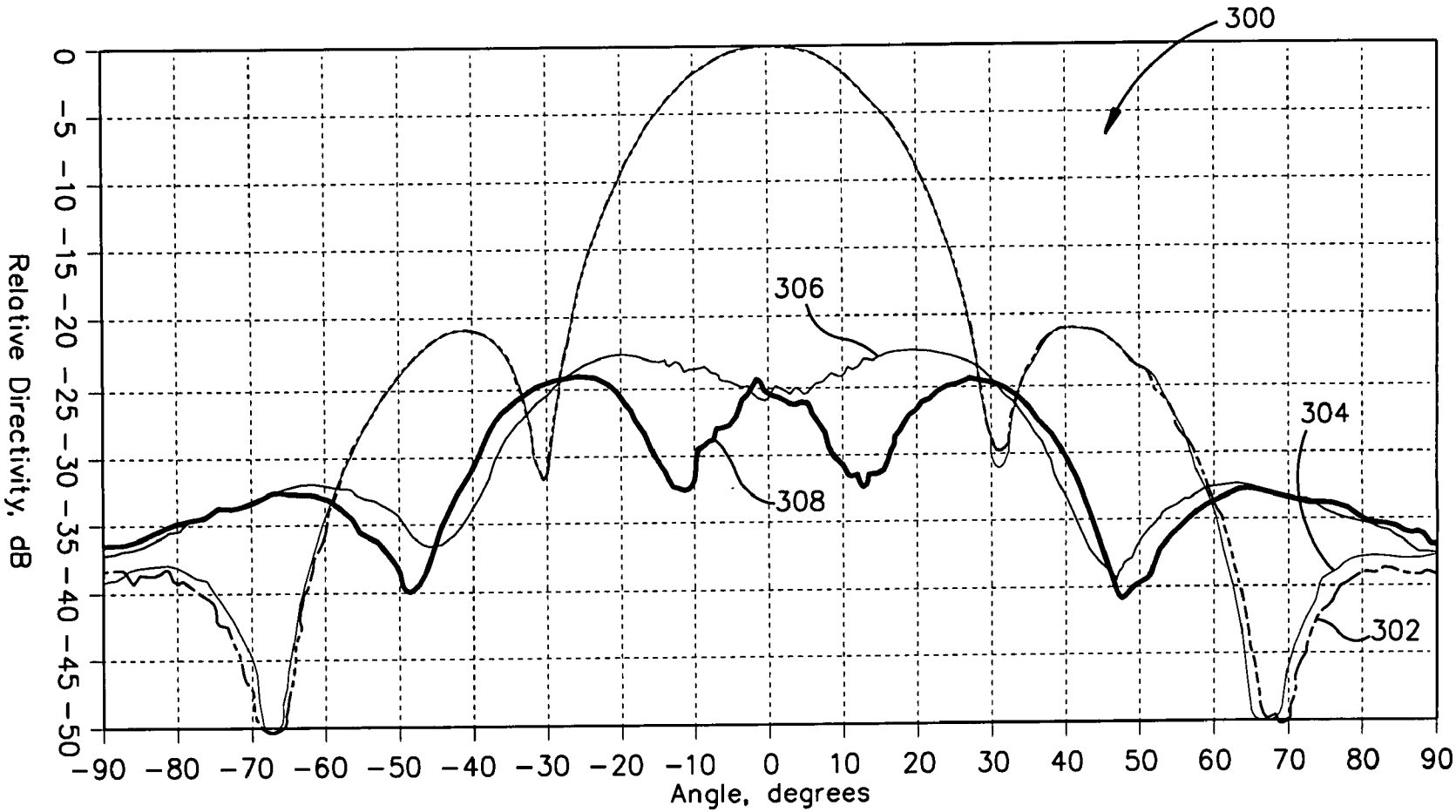
FIG. 10 is a graph depicting an example of typical radiation patterns for an antenna according to an aspect of the present invention.

FIG. 10 depicts a graph 300 of relative directivity (in dB) versus angle (in degrees) representing a typical measured radiation pattern for an antenna constructed according to an aspect of the present invention. The graph 300 shows two principal polarization (RHCP) patterns, the E-plane 302 and the H-plane 304. The circularly polarized fields from this horn antenna provide symmetrical patterns at E-plane and H-plane, resulting in overlapping principal polarization (RHCP) patterns, as shown in FIG. 10. The two cross polarization (LHCP) patterns, indicated at 306 and 308, are about −25 dB level below the peak. Thus, from the graph 300, it is shown that the antenna AR <0.9 dB, a characteristic of a good circularly polarized horn antenna.

Figure 11:
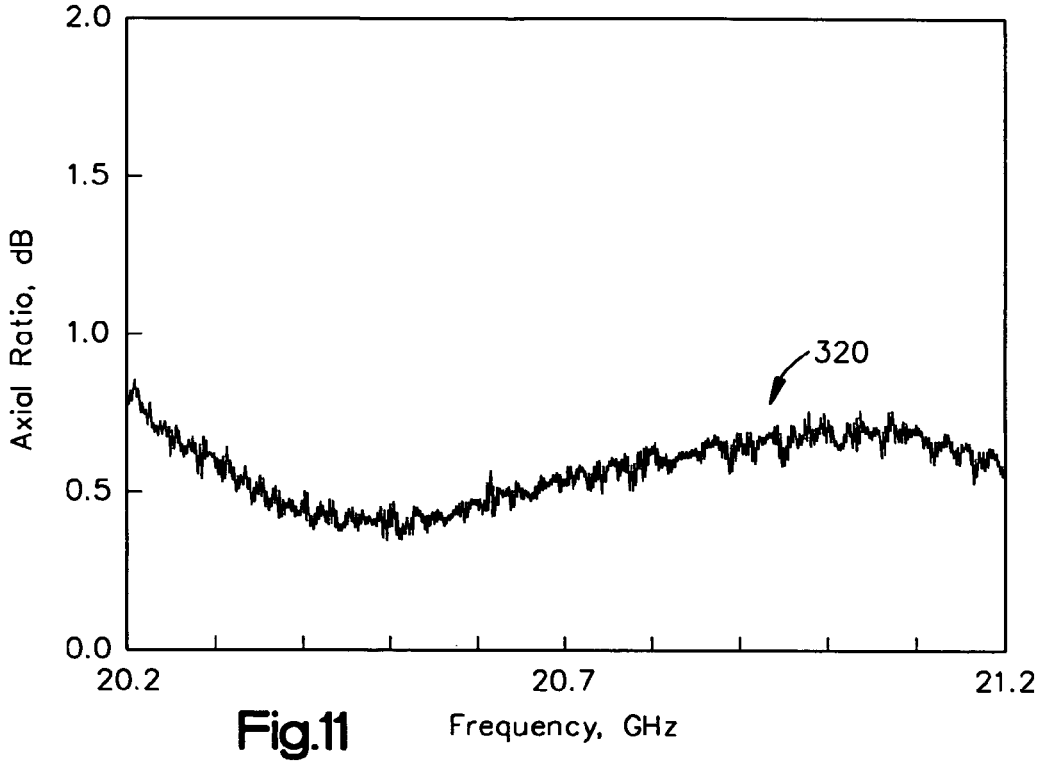
FIG. 11 is a graph depicting measured axial ratio as a function of frequency for an antenna according to an aspect of the present invention.
Figure 12:
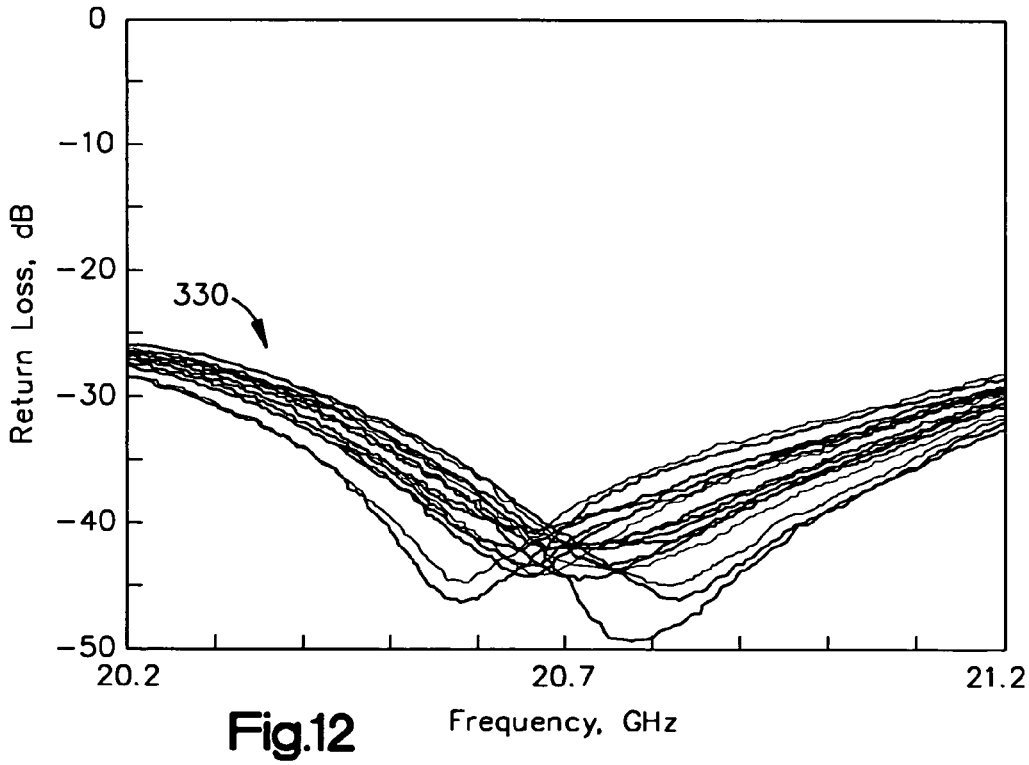
FIG. 12 is a graph depicting a measured input return loss as a function of frequency for an antenna according to an aspect of the present invention.

FIG. 11 depicts a graph 320 of AR as a function of frequency, representing the frequency sweep of AR performance for an antenna implemented according to an aspect of the present invention. In the frequency band of interest, the AR is below 0.9 dB. Another graph 330, in FIG. 12, provides plots of input return loss shown for a plurality of horn antennas implemented in accordance with an aspect of the present invention. The return loss of the antennas value is below approximately −25 dB over the frequency band of interest. Thus, this horn antenna design provides very good impedance match to the subsequent components in the system. A conservative estimate of the insertion loss for such antennas is low, such as about −0.1 dB. The results for the return loss demonstrate the excellent repeatability of the electrical performance for antennas fabricated according to an aspect of the present invention. It will be understood and appreciated that the antenna can be easily integrated with a solid state power amplifier module for a transmit phased array application, or with a low noise amplifier module for a receive phased array application.

In view of the forgoing, with the length reduction on the horn, polarizer and transition sections, a compact horn antenna design can be provided at a reduced cost and provide high performance over a broad range of frequencies. The antenna design is readily scalable to accommodate different aperture sizes or different frequency bands. It is expected that that the design can provide high performances at high frequencies, including up to and beyond 60 GHz.

By way of further example, an antenna having a total length of about 4.1" can be provided that provides comparable performance to an antenna having typically 8" feed assembly, a considerable reduction in length. Additionally, as described herein, the polarization can be easily converted from RHCP to LHCP by modifying the polarizer structure. The internal structure of this horn antenna design can be very simple (e.g., substantially smooth and continuous interior sidewalls), enabling low cost, single-piece fabrication. This compact horn antenna design is very suitable for phased array antennas in satellite communications (see, e.g., FIG. 9).

Comparing this design with comparable performing antennas, height and weight parameters can be reduced by 50% or more. Significantly, the cost of making each antenna, according to an aspect of the present invention, can be reduced by approximately 95%. This reduction can be achieved when the antenna is fabricated from the preferred material in the industry, namely, aluminum. The consistency in the measured performance of this design allows for margin to be given back to other system components.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A polarizer for an antenna, comprising:

a generally cylindrical sidewall portion extending between spaced apart end portions; and at least one polarizing structure extending substantially continuously along an interior of the sidewall portion and extending radially inwardly relative to the sidewall portion according to a first radius in a longitudinal direction and a second radius in a transverse direction.

2. The polarizer of claim 1, wherein the at least one polarizing structure further comprises a generally radially inwardly extension of the sidewall portion.

3. The polarizer of claim 2, wherein the interior of the sidewall portion, including the radially inwardly extension thereof, provides a substantially smooth and continuous surface along the interior of the sidewall portion.

4. The polarizer of claim 2, wherein the radially inward extension of the sidewall portion further comprises one of a generally semi-torus and semi-ellipsoidal three dimensional shape.

5. The polarizer of claim 1, wherein the at least one polarizing structure comprises a section of the sidewall portion deformed inwardly relative to the sidewall portion.

6. The polarizer of claim 1, wherein the at least one polarizing structure further comprises a pair of diametrically opposed polarizing structures arranged angularly relative to each other to provide an axial ratio.

7. The polarizer of claim 1, further comprising a transition section integrally formed at a proximal end of the polarizer.

8. The polarizer of claim 7, wherein the transition section further comprises a single step transition configured to substantially match impedances of the polarizer and an associated waveguide.

9. The polarizer of claim 7, the transition section further comprising a quarter wavelength step transition.

10. The polarizer of claim 7, further comprising a horn extending from a distal end of the polarizer.

11. The polarizer of claim 10, wherein the horn, the polarizer and the transition section comprise an integral structure.

12. The polarizer of claim 10, the horn further comprising a plurality of flare sections, at least some of the flare sections have different flare angles relative to a longitudinal axis thereof.

13. The polarizer of claim 10, further comprising a generally smooth and continuous interior sidewall extending from the proximal end of the polarizer to the distal end of the horn.

14. A feed structure for an antenna, comprising:

a polarizer includes a sidewall portion having spaced apart ends, at least one polarizing structure extending from an interior of the sidewall portion of the polarizer;

a transition stage located at a proximal one of the ends of the sidewall portion of the polarizer, the transition stage comprising a step transition integrally formed with the polarizer from a single piece of material.

15. The feed structure of claim 14, wherein the at least one polarizing structure further comprises a generally radially inwardly extension of the sidewall portion having a first dimension in a longitudinal direction and a second dimension in a transverse direction.

16. The feed structure of claim 14, wherein the at least one polarizing structure comprises a section of the sidewall portion deformed inwardly relative to the sidewall portion.

17. The feed structure of claim 14, wherein the at least one polarizing structure further comprises a pair of diametrically opposed polarizing structures arranged angularly relative to each other about a longitudinal axis of the polarizer.

18. The feed structure of claim 14, wherein the transition stage further comprises a single step transition configured to substantially match impedances of the polarizer and an associated waveguide.

19. The feed structure of claim 14, further comprising a horn extending from a distal one of the ends of the polarizer.

20. The feed structure of claim 19, wherein the horn, the polarizer and the transition stage comprise an integral structure.

21. The feed structure of claim 19, wherein the horn comprises a multi-flare horn.

22. An antenna comprising:

a horn having a sidewall portion that includes a plurality of flare sections, at least some of the flare sections have different flare angles relative to a longitudinal axis thereof; and a polarizer extending from a proximal end of the horn and terminating in a proximal end of the polarizer, the polarizer including a sidewall extending longitudinally between spaced apart ends, at least one polarizing structure extending radially inwardly from the sidewall of the polarizer to provide a substantially continuous and smooth inward extension along part of an interior of the sidewall within the polarizer.

23. The antenna of claim 22, further comprising a transition stage located at the proximal end of the polarizer to provide an interface to an associated waveguide.

24. The antenna of claim 23, the transition stage further comprising a quarter wavelength single step transformer configured to substantially match impedances of the polarizer and the waveguide.

25. The antenna of claim 23, wherein the horn, the polarizer and the transition stage comprise an integral structure formed from a single piece of material.

26. The antenna of claim 22, wherein the horn further comprises four flare sections having different flare angles.

27. The antenna of claim 22, wherein the horn further comprises a generally smooth interior sidewall portion.

28. The antenna of claim 22, wherein the polarizing structure comprises a continuous portion of the sidewall of the polarizer that extends radially inwardly relative to the end portions of the sidewall of the polarizer.

29. The antenna of claim 22, wherein the polarizing structure further comprises one of a generally semi-torus, semi-ellipsoidal or semi-spheroidal contour extending inwardly relative to the sidewall portion of the polarizer near at least one end portion thereof the polarizer.

30. The antenna of claim 22, wherein the polarizing structure further comprises one of a vane polarizer and a continuous step polarizer.

31. The antenna of claim 22, further comprising at least two opposed polarizing structures located along the interior of the sidewall portion of the polarizer at an angular relationship relative to each other to provide a desired axial ratio.

* * * * *